US008273198B1

(12) United States Patent
Hordos

(10) Patent No.: US 8,273,198 B1
(45) Date of Patent: Sep. 25, 2012

(54) GAS GENERANT WITH AUTO-IGNITION FUNCTION

(75) Inventor: Deborah L. Hordos, Troy, MI (US)

(73) Assignee: TK Holdings, Inc., Armada, MI (US)

( * ) Notice: Subject to any disclaimer, the term of this patent is extended or adjusted under 35 U.S.C. 154(b) by 2 days.

(21) Appl. No.: 12/925,930

(22) Filed: Nov. 1, 2010

Related U.S. Application Data

(60) Provisional application No. 61/280,295, filed on Oct. 31, 2009.

(51) Int. Cl.
*C06B 31/00* (2006.01)
*D03D 23/00* (2006.01)
*D03D 43/00* (2006.01)

(52) U.S. Cl. ..... 149/45; 149/109.2; 149/109.4

(58) Field of Classification Search ..... 149/45, 149/109.2, 109.4
See application file for complete search history.

(56) References Cited

U.S. PATENT DOCUMENTS 3,647,393 A * 3/1972 Leising et al. ..... 280/736
6,361,630 B2 * 3/2002 Helmy et al. ..... 149/19.4

* cited by examiner

*Primary Examiner* — James McDonough
(74) *Attorney, Agent, or Firm* — L.C. Begin & Associates, PLLC.

(57) ABSTRACT

Gas generating compositions include a primary fuel selected from aminotetrazoles and heterocyclic amines; a carbonyl donor selected from formaldehyde, formamide, or an ammonium formate; and a basic constituent selected from alkali and alkaline earth metal aminotetrazoles, hydantoin and basic derivatives thereof, and mixtures thereof. Gas generators and vehicle occupant protection systems incorporating the present compositions are also described.

15 Claims, 1 Drawing Sheet

GAS GENERANT WITH AUTO-IGNITION FUNCTION

CROSS-REFERENCE TO RELATED APPLICATIONS

This application claims the benefit of U.S. Provisional Application Ser. No. 61/280,295 filed on Oct. 31, 2009.

TECHNICAL FIELD

The present invention relates generally to gas generating systems, and to gas generating compositions employed in gas generator devices for automotive restraint systems, for example.

BACKGROUND OF THE INVENTION

The present invention relates to gas generant compositions that upon combustion produce a relatively smaller amount of solids and a relatively abundant amount of gas. It is an ongoing challenge to reduce the amount of solids and increase the amount of gas thereby decreasing the filtration requirements for an inflator. As a result, the filter may be either reduced in size or eliminated altogether thereby reducing the weight and/or size of the inflator. Additionally, reduction of combustion solids provides relatively greater amounts of gaseous products per gram or unit of gas generating composition. Accordingly, less gas generant is required when greater mols of gas are produced per gram of gas generant. The result is typically a smaller and less expensive inflator due to reduced manufacturing complexity. Accordingly, optimizing the processing of constituents that contribute to less solids and more gas would assist in the production of such gas generants, which may also be known as "smokeless" gas generants.

Yet another concern in the manufacture of "smokeless" gas generants is the loss of energetic behavior and therefore gaseous yield, during the molding or forming of the gas generant. This is particularly relevant with regard to polymeric constituents including polymeric 5-aminotetrazole.

SUMMARY OF THE INVENTION

Gas generating compositions include a primary fuel selected from aminotetrazoles and heterocyclic amines; a carbonyl donor selected from formaldehyde, formamide, or an ammonium formate; and a basic constituent selected from alkali and alkaline earth metal aminotetrazoles, hydantoin and basic derivatives thereof, and mixtures thereof. Gas generators and vehicle occupant protection systems incorporating the present compositions are also described.

DETAILED DESCRIPTION OF THE INVENTION

Figure 1:
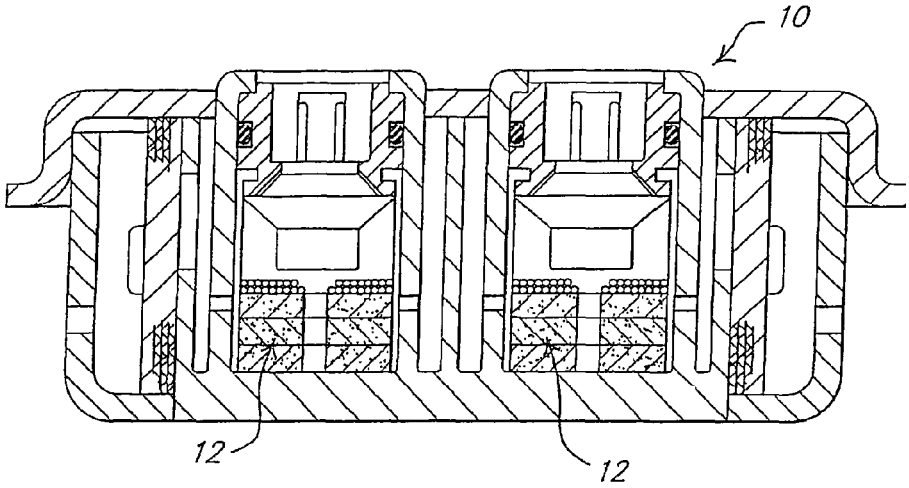
FIG. 1 is a cross-sectional side view showing the general structure of an inflator in accordance with the present invention.

The above-referenced concerns are resolved by gas generators or gas generating systems containing novel fuel constituents within novel gas generant compositions. Novel fuel constituents or compounds may be defined as the product formed by the process described below. The various compositions may also be used as energetic binders or molding agents for gas generants. Furthermore, the various compositions may be used to create energetic adhesives and foams with predetermined porosity.

Compositions of the present invention contain a fuel selected from an aminotetrazole moiety having an acidic character; a basic constituent such as an alkali or alkaline earth metal salt of an aminotetrazole; and a compound containing a carbonyl group such as formaldehyde or formamide.

In one composition or embodiment, the fuel constituent 5-aminotetrazole is combined with a basic constituent such as potassium 5-aminotetrazole and ammonium formate.

In general, the fuel constituent may be selected from 5-aminotetrazole and other aminotetrazole moieties having an acidic character. The fuel constituent may also be selected from other heterocyclic amines and/or aminotetrazole moieties including 1-methyl-5-aminotetrazole and 2-methyl-5-aminotetrazole. U.S. Pat. Nos. 5,035,757 and 5,139,588 describe various 5-aminotetrazole moieties and are herein incorporated by reference in their entirety. The total fuel component is provided at about 5-50 wt % and more preferably at about 22-36 wt %, of the gas generant composition.

Optional secondary fuels include tetrazoles such as nonmetal salts of azoles such as diammonium salt of 5,5'-bis-1H-tetrazole: nitrate salts of azoles such as 5-aminotetrazole; nitramine derivatives of azoles such as 5-aminotetrazole; metal salts of nitramine derivatives of azoles such as dipotassium 5-aminotetrazole; nonmetal salts of nitramine derivatives of azoles such as monoammonium 5-aminotetrazole and; guanidines such as dicyandiamide; salts of guanidines such as guanidine nitrate; nitro derivatives of guanidines such as nitroguanidine; azoamides such as azodicarbonamide; nitrate salts of azoamides such as azodicarbonamidine dinitrate; and mixtures thereof. The secondary fuel can be used within this system as co-fuels to the primary fuel. If used, the secondary fuel when combined with the primary fuel constitutes about 5-50 wt % of the gas generant composition. By itself, the secondary fuel constitutes 0-45 wt %, and more preferably about 15-30 wt % when used.

The basic constituent may be selected from alkali and alkaline earth metal salts of aminotetrazoles such as potassium 5-aminotetrazole; hydantoin and basic derivatives thereof, including but not limited to those described in U.S. Pat. Nos. 5,202,339, 3,984,606, and 6,429,181, herein incorporated by reference in their entirety. The basic constituent is provided at least in an amount of about 2% of the total gas generant composition, and in one embodiment at about 2-18% by weight of the gas generant composition.

Compounds containing at least one carbonyl group of the present invention selected from formaldehyde; formamide; and ammonium formates selected from ammonium formate, alkyl(C1-C4)ammonium formates, and ammonium diformates; and mixtures thereof. The carbonyl group constituent is provided at least at about 10 wt % of the total composition and more preferably at about 35-65 wt % of the total gas generant composition. In one embodiment, the carbonyl group constituent is provided whereby each carbonyl group present in the reactive intermediates such as formaldehyde and formamide generated from the decomposition of ammonium formate or an ammonium formate constituent, is reacted with one mol of 5-aminotetrazole.

If desired, an additional oxidizer component may also be selected from at least one exemplary oxidizer selected from basic metal nitrates, and, metal and nonmetal nitrates, chlorates, perchlorates, nitrites, oxides, and peroxides such as basic copper (II) nitrate, strontium nitrate, potassium nitrate, potassium nitrite, iron oxide, and copper oxide. Other oxidizers as recognized by one of ordinary skill in the art may also be employed. When employed, the oxidizer is generally provided at about 50-95 wt % of the total gas generant composition.

The compositions of the present invention are formed from constituents as provided by known suppliers such as Aldrich or Fisher Chemical companies. The compositions may be mixed and then molded in a known manner, or otherwise mixed and manufactured as known in the art. The compositions may be employed in gas generators typically found in airbag devices or occupant protection systems, or in safety belt devices, or in gas generating systems such as a vehicle occupant protection system, all manufactured as known in the art, or as appreciated by one of ordinary skill.

In yet another aspect of the present invention, the present compositions may be formulated as energetic binders by the following method. The method begins by first heating a bath of aqueous and polymerizable formaldehyde or heating a bath of formamide, at a preferred temperature of about 40 C. Next, the aminotetrazole fuel such as 5-aminotetrazole is added to the bath as a granulated solid, for example. Next, the basic constituent such as potassium 5-aminotetrazole is added as a granulated solid, for example. The mixture is then stirred and heated until it begins to set up or polymerize. The mixture is placed in a conditional oven and heated at about 105 C for about two hours to permit the mixture to completely polymerize or set up.

The mixture may then be provided as a monolithic and energetic binder, in the state it exits the conditional oven. Alternatively, the mixture may be ground and mixed, and then pelletized with other known gas generating constituents such as those described below, including secondary fuels and oxidizers. Of course, granulated compositions containing the ground energetic binder combined with granulated known gas generating constituents may also be provided. The advantage of using the resultant energetic binder, either as a discrete energetic composition, or, as an adjunct in combination with other known gas generating constituents is that the volumetric and molar gas output is enhanced by the use of an energetic binder as opposed to inert known binders such as clay. Furthermore, the amount of solids is reduced when using the current energetic binders as compared to the use of clay or cellulosic binders such as carboxylacetate butyrate, for example. As such, the filtering requirement is mitigated thereby resulting in associated inflators having a reduced weight due to reduced filtering requirements.

EXAMPLES

Example 1

A composition was formed by first heating at 40 C and continuously stirring a bath of aqueous and polymerizable formaldehyde provided at about 0.070 mols. Potassium 5-aminotetrazole (K5AT) and 5-aminotetrazole (5AT) were then added to the heated formaldehyde as separate solids at about 0.035 mols each, thereby equating to 0.14 mols total in the composition. The clear solution polymerized after ten minutes. The pH was about 6. The polymerized mixture was then placed in a conditional oven for about two hours at 105 C, thereby resulting in complete curing. The resulting polymer was observed to have good adhesive properties. As measured by Differential Scanning calorimetry (DSC), the DSC peak was measured at 255.93 C, and the heat in Joules per gram was measured at about 808.84.

Example 2

A composition was formed by first heating at 40 C and continuously stirring a bath of aqueous and polymerizable formaldehyde provided at about 0.052 mols. Potassium 5-aminotetrazole and 5-aminotetrazole were then added to the heated formaldehyde as separate solids at about 0.035 and 0.017 mols, respectively, thereby equating to 0.104 mols total in the composition. The clear solution polymerized after ten minutes. The pH was about 5. The polymerized mixture was then placed in a conditional oven for about two hours at 105 C, thereby resulting in complete curing. The resulting polymer was observed to have good adhesive properties. As measured by Differential Scanning calorimetry (DSC), the DSC peak was measured at 250.43 C, and the heat in Joules per gram was measured at about 944.21.

Example 3

A composition was formed by first heating at 40 C and continuously stirring a bath of aqueous and polymerizable formaldehyde provided at about 0.044 mols. Potassium 5-aminotetrazole and 5-aminotetrazole were then added to the heated formaldehyde as separate solids at about 0.035 and 0.009 mols, respectively, thereby equating to 0.088 mols total in the composition. The clear solution polymerized after ten minutes. The pH was about 4. The polymerized mixture was then placed in a conditional oven for about two hours at 105 C, thereby resulting in complete curing. The resulting polymer was observed to have good adhesive properties. As measured by Differential Scanning calorimetry (DSC), the DSC peak was measured at 248.15 C, and the heat in Joules per gram was measured at about 700.39.

Example 4

A composition was formed by first heating at 40 C and continuously stirring a bath of aqueous and polymerizable formaldehyde provided at about 0.035 mols. 5-aminotetrazole was then added to the heated formaldehyde as a separate solid at about 0.035 mols, thereby equating to 0.070 mols total in the composition. Fifteen milliliters of distilled water was added to assist in mixing and stirring. The mixture had a plastic appearance but had no adhesive properties. The mixture did not polymerize and when placed in a conditional oven for about two hours at 105 C, broke into a powder. As measured by Differential Scanning calorimetry (DSC), the DSC peak was measured at 238.57 C.

Example 5

A composition was formed by first heating at 40 C and continuously stirring a bath of formamide provided at about 0.070 mols. Potassium 5-aminotetrazole and 5-aminotetrazole were then added to the heated formamide as separate solids at about 0.035 mols each, thereby equating to 0.14 mols total in the composition. The clear solution polymerized after ten minutes. The pH was about 6. The polymerized mixture was then placed in a conditional oven for about four hours at 105 C, thereby resulting in complete curing. The resulting polymer was observed to have good adhesive properties. As measured by Differential Scanning calorimetry (DSC), the DSC peak was measured at 215.06 C, and the heat in Joules per gram was measured at about 276.4.

Example 6

A composition was formed by first heating at 50 C and continuously stirring a bath of formamide provided at about 0.070 mols. Hydantoin and 5-aminotetrazole were then added to the heated formamide as separate solids at about 0.035 mols each, thereby equating to 0.14 mols total in the composition. The clear solution polymerized after ten to twelve minutes. The pH was about 6-7. The polymerized mixture was then placed in a conditional oven for about four hours at 105 C, thereby resulting in complete curing. The resulting polymer was observed to be somewhat tacky. As measured by Differential Scanning calorimetry (DSC), the DSC peak was measured at 206.8 C, and the heat in Joules per gram was measured at about 265.4.

Example 7

A composition was formed by mixing at room temperature 27.5 wt % of 5-aminotetrazole, 7.5 wt % potassium 5-aminotetrazole, 10.0 wt % aqueous and polymerizable formaldehyde, 50 wt % potassium nitrate, and 5 wt % molybdenum trioxide. The mixture was then placed in a mold at 105 C. The material fully cured after two hours.

Example 8

A composition was formed by mixing at room temperature 27.5 wt % of 5-aminotetrazole, 7.5 wt % potassium 5-aminotetrazole, 10.0 wt % aqueous and polymerizable formamide, 50 wt % potassium nitrate, and 5 wt % molybdenum trioxide. The mixture was then placed in a mold at 105 C. The material fully cured after two hours.

As per examples 1-8, potassium 5-aminotetrazole is the preferred basic constituent or activator for the 5-aminotetrazole polymer system. This is illustrated when one compares the heat values of all the examples. A correlation is seen as potassium 5-aminotetrazole decreases so does energy output. Formaldehyde is the preferred carbonyl donor for polymerization based on the same premise, specifically when one compares overall energy of samples with formaldehyde compared to formamide.

Example 9

When combusted, 5AT-based polymeric binder made as provided in Example 5 resulted in an oxygen balance of −63.67, a gas output of 3.82 mols/100 g, and a volumetric gas output of 6.29 mols/100 cubic centimeters. When heat aged at 107 C for 400 hours, the binder had a percent weight loss of 0.19.

Example 10

When combusted, a poly dimethyl siloxane (PDMS) polymeric binder resulted in an oxygen balance of −172.61, a gas output of 1.35 mols/100 g, and a volumetric gas output of 1.35 mols/100 cubic centimeters. When heat aged at 107 C for 400 hours, the binder had a percent weight loss of 0.2.

Example 11

When combusted, a binder containing carboxy acetate butyrate (CAB) resulted in an oxygen balance of −162.82, a gas output of 2.90 mols/100 g when combusted, and a volumetric gas output of 3.48 mols/100 cubic centimeters. When heat aged at 107 C for 400 hours, the binder had a percent weight loss of 0.3.

Example 12

When combusted, a binder containing sodium carboxy methyl cellulose (Na-CMC) based polymer binder resulted in an oxygen balance of −86.00, a gas output of 2.30 mols/100 g when combusted, and a volumetric gas output of 2.99 mols/100 cubic centimeters. When heat aged at 107 C for 400 hours, the binder had a percent weight loss of 0.8.

Example 13

When combusted, a binder containing nitrocellulose (NC) resulted in an oxygen balance of −34.51, a gas output of 2.96 mols/100 g when combusted, and a volumetric gas output of 4.59 mols/100 cubic centimeters. When heat aged at 107 C for 400 hours, the binder had a percent weight loss of 20.9.

Example 14

When combusted, a binder containing ammonium polyvinyltetrazole resulted in an oxygen balance of −134.41, a gas output of 3.76 mols/100 g when combusted, and a volumetric gas output of 5.98 mols/100 cubic centimeters. When heat aged at 107 C for 400 hours, the binder had a percent weight loss of 0.2.

As shown in examples 9-14, the 5AT-based polymer (and more generally, an aminotetrazole-based polymer) of the present invention results in superior performance with regard to gas yield and thermal stability. Nitrate esters that are used as binders present a relatively favorable gas yield, but also exhibit less-than-favorable thermal stability for gas generating applications; nitrocellulose in particular has poor thermal stability.

As shown in FIG. 1, an exemplary inflator or gas generating system 10 incorporates a dual chamber design to tailor containing a primary gas generating composition 12 formed as described herein, may be manufactured as known in the art. U.S. Pat. Nos. 6,422,601, 6,805,377, 6,659,500, 6,749,219, and 6,752,421 exemplify typical airbag inflator designs and are each incorporated herein by reference in their entirety.

Figure 2:
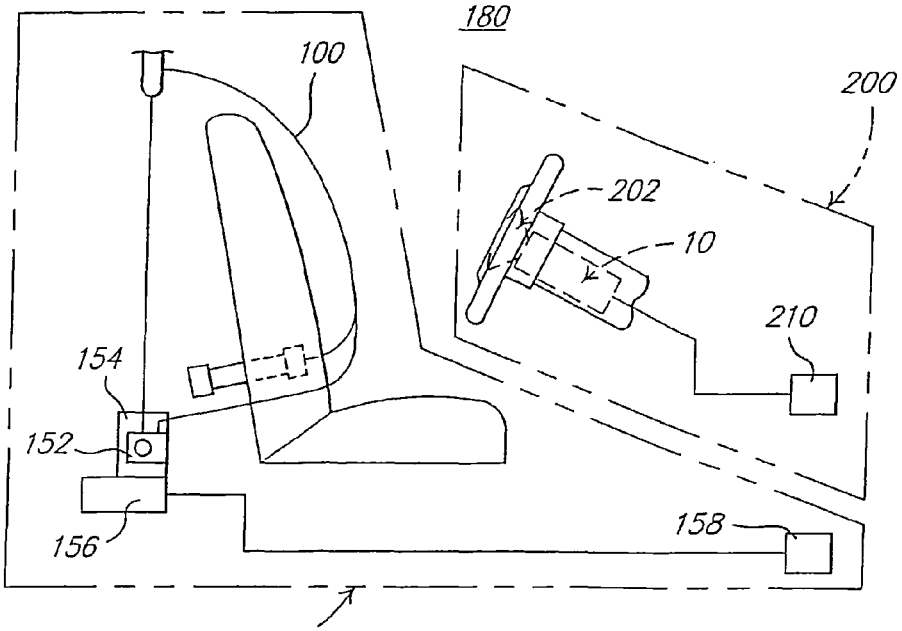
FIG. 2 is a schematic representation of an exemplary vehicle occupant restraint system containing a gas generant composition in accordance with the present invention.

Referring now to FIG. 2, the exemplary inflator or gas generating system 10 described above may also be incorporated into an airbag system 200. Airbag system 200 includes at least one airbag 202 and an inflator 10 containing a gas generant composition 12 in accordance with the present invention, coupled to airbag 202 so as to enable fluid communication with an interior of the airbag. Airbag system 200 may also include (or be in communication with) a crash event sensor 210. Crash event sensor 210 includes a known crash sensor algorithm that signals actuation of airbag system 200 via, for example, activation of airbag inflator 10 in the event of a collision.

Referring again to FIG. 2, airbag system 200 may also be incorporated into a broader, more comprehensive vehicle occupant restraint system 180 including additional elements such as a safety belt assembly 150. FIG. 2 shows a schematic diagram of one exemplary embodiment of such a restraint system. Safety belt assembly 150 includes a safety belt housing 152 and a safety belt 100 extending from housing 152. A safety belt retractor mechanism 154 (for example, a spring-loaded mechanism) may be coupled to an end portion of the belt. In addition, a safety belt pretensioner 156 containing gas generating/auto ignition composition 12 may be coupled to belt retractor mechanism 154 to actuate the retractor mechanism in the event of a collision. Typical seat belt retractor mechanisms which may be used in conjunction with the safety belt embodiments of the present invention are described in U.S. Pat. Nos. 5,743,480, 5,553,803, 5,667,161, 5,451,008, 4,558,832 and 4,597,546, incorporated herein by reference. Illustrative examples of typical pretensioners with which the safety belt embodiments of the present invention may be combined are described in U.S. Pat. Nos. 6,505,790 and 6,419,177, incorporated herein by reference.

Safety belt assembly 150 may also include (or be in communication with) a crash event sensor 158 (for example, an inertia sensor or an accelerometer) including a known crash sensor algorithm that signals actuation of belt pretensioner 156 via, for example, activation of a pyrotechnic igniter (not shown) incorporated into the pretensioner. U.S. Pat. Nos. 6,505,790 and 6,419,177, previously incorporated herein by reference, provide illustrative examples of pretensioners actuated in such a manner.

It should be appreciated that safety belt assembly 150, airbag system 200, and more broadly, vehicle occupant protection system 180 exemplify but do not limit gas generating systems contemplated in accordance with the present invention.

It should further be understood that the preceding is merely a detailed description of various embodiments of this invention and that numerous changes to the disclosed embodiments can be made in accordance with the disclosure herein without departing from the scope of the invention. The preceding description, therefore, is not meant to limit the scope of the invention.

What is claimed is:

1. A composition comprising:

a primary fuel selected from the group of aminotetrazoles and heterocyclic amines wherein said total fuel component is provided at about 5-50 weight percent of the total composition;

a carbonyl donor selected from formaldehyde, formamide and an ammonium formate, said carbonyl donor provided at least at about 10 weight percent of the total composition; and a basic constituent selected from alkali and alkaline earth metal salts of aminotetrazoles, hydantoin and basic derivatives thereof, and mixtures thereof, said basic constituent provided at least at about two weight percent of the total composition wherein said carbonyl donor is provided at about 35-65 weight percent of the total composition.

2. The composition of claim 1 wherein said primary fuel is selected from 5-aminotetrazole, 1-methyl-5-aminotetrazole, and 2-methyl-5-aminotetrazole.

3. The composition of claim 1 wherein said ammonium formate is selected from ammonium formate, alkyl(C1-C4) ammonium formate, ammonium diformates, and mixtures thereof.

4. The composition of claim 1 wherein said basic constituent is potassium 5-aminotetrazole.

5. The composition of claim 1 comprising a secondary fuel selected from nonmetal salts of azoles; nitrate salts of azoles; nitramine derivatives of azoles; metal salts of nitramine derivatives of azoles; nonmetal salts of nitramine derivative of azole; guanidines; salts of guanidines; nitro derivatives of guanidines; azoamides; nitrate salts of azoamides; and mixtures thereof.

6. The composition of claim 1 further comprising an oxidizer selected from basic metal nitrates; and metal and nonmetal nitrates, chlorates, perchlorates, nitrites, oxides, and peroxides.

7. The composition of claim 1 containing 5-aminotetrazole, potassium 5-aminotetrazole, and formaldehyde.

8. A composition comprising:

a primary fuel selected from the group of aminotetrazoles and heterocyclic amines wherein said total fuel component is provided at about 5-50 weight percent of the total composition;

a second compound containing a carbonyl group, said second compound provided at least at about 10 weight percent of the total composition; and a basic constituent selected from alkali and alkaline earth metal salts of aminotetrazoles, hydantoin and basic derivatives thereof, and mixtures thereof, said basic constituent provided at least at about two weight percent of the total composition, wherein said second compound is provided at about 35-65 weight percent of the total composition.

9. The composition of claim 8 comprising a secondary fuel selected from nonmetal salts of azoles; nitrate salts of azoles; nitramine derivatives of azoles; metal salts of nitramine derivatives of azoles; nonmetal salts of nitramine derivative of azole; guanidines; salts of guanidines; nitro derivatives of guanidines; azoamides; nitrate salts of azoamides; and mixtures thereof.

10. The composition of claim 8 wherein said primary fuel is selected from 5-aminotetrazole, 1-methyl-5-aminotetrazole, and 2-methyl-5-aminotetrazole.

11. The composition of claim 8 wherein said second compound is selected from formaldehyde, formamide, ammonium formate, alkyl(C1-C4)ammonium formate, ammonium diformates, and mixtures thereof.

12. The composition of claim 8 wherein said basic constituent is potassium 5-aminotetrazole.

13. The composition of claim 8 further comprising a secondary oxidizer selected from basic metal nitrates; and metal and nonmetal nitrates, chlorates, perchlorates, nitrites, oxides, and peroxides.

14. The composition of claim 8 containing 5-aminotetrazole, potassium 5-aminotetrazole, and ammonium formate.

15. A composition comprising:

5-aminotetrazole provided at about 5-50 weight percent of the total composition; formaldehyde provided at least at about 10 weight percent of the total composition; and potassium 5-aminotetrazole provided at least at about two weight percent of the total composition.

* * * * *

UNITED STATES PATENT AND TRADEMARK OFFICE

CERTIFICATE OF CORRECTION

PATENT NO. : 8,273,198 B1
APPLICATION NO. : 12/925930
DATED : September 25, 2012
INVENTOR(S) : Hordos It is certified that error appears in the above-identified patent and that said Letters Patent is hereby corrected as shown below:

Col. 3, Line 46; Delete “carboxylacetate” and Insert --carboxyl acetate--.

Col. 3, Example 1, Line 67; Delete “calorimetry” and Insert --Calorimetry--.

Col. 4, Example 2, Line 17; Delete “calorimetry” and Insert --Calorimetry--.

Col. 4, Example 3, Line 35; Delete “calorimetry” and Insert --Calorimetry--.

Col. 4, Example 4, Line 51; Delete “calorimetry” and Insert --Calorimetry--.

Col. 4, Example 5, Line 67; Delete “calorimetry” and Insert --Calorimetry--.

Col. 5, Example 6, Line 16; Delete “calorimetry” and Insert --Calorimetry--.

Signed and Sealed this
Eighteenth Day of December, 2012

David J. Kappos

David J. Kappos
*Director of the United States Patent and Trademark Office*